US007701140B2

(12) United States Patent
Marien et al.

(10) Patent No.: US 7,701,140 B2
(45) Date of Patent: Apr. 20, 2010

(54) HIGH-PRESSURE DISCHARGE LAMP

(75) Inventors: Leo Gustaaf Joanna Emiel Marien, Turnhout (BE); Nancy Jean Caruso, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 237 days.

(21) Appl. No.: 10/568,205

(22) PCT Filed: Aug. 4, 2004

(86) PCT No.: PCT/IB2004/051389

§ 371 (c)(1),
(2), (4) Date: Feb. 13, 2006

(87) PCT Pub. No.: WO2005/017946

PCT Pub. Date: Feb. 24, 2005

(65) Prior Publication Data

US 2006/0214589 A1 Sep. 28, 2006

(30) Foreign Application Priority Data

Aug. 18, 2003 (EP) ..... 03102578

(51) Int. Cl.
*H01J 17/16* (2006.01)

(52) U.S. Cl. ..... 313/634; 313/324; 313/25

(58) Field of Classification Search ..... 313/627–643, 313/567, 111–117, 25–27, 318.01–318.09, 313/324; 439/615, 739; 445/24, 26, 29, 445/22

See application file for complete search history.

(56) References Cited

U.S. PATENT DOCUMENTS 4,888,517 A 12/1989 Keeffe et al.
4,977,346 A * 12/1990 Gibson et al. ..... 313/25
5,510,676 A * 4/1996 Cottaar et al. ..... 313/639
5,532,543 A * 7/1996 Van Der Leeuw et al. ..... 313/25

(Continued)

FOREIGN PATENT DOCUMENTS

DE 3406820 A1 10/1984

(Continued)

OTHER PUBLICATIONS

Written Opinion of the International Searching Authority PCT/IB2004/051389.

*Primary Examiner*—Peter J Macchiarolo
*Assistant Examiner*—Donald L Raleigh

(57) ABSTRACT

The invention relates to a high-pressure discharge lamp with an outer envelope (1) in which a discharge vessel (11) is arranged around a longitudinal axis (22). The discharge vessel encloses, in a gastight manner, a discharge space (13) provided with an ionizable filling. The discharge vessel has a first (2) and a second (3) mutually opposed neck-shaped portion through which a first (4) and a second (5) current-supply conductor, respectively, extend to a pair of electrodes (6, 7) arranged in the discharge space (13). The outer envelope (1) has a bulb-shaped portion (2) adjacent the discharge space with a wall thickness $d_1$. The remainder of the outer envelope has a wall thickness $d_2$. The ratio of $d_1$ and $d_2$ is in the range: Formula (I). Preferably, Formula (II), the bulb-shaped portion is formed in a mold. A simplified and compact high-pressure discharge lamp is provided by the invention.

5 Claims, 3 Drawing Sheets

U.S. PATENT DOCUMENTS

Figure 1:
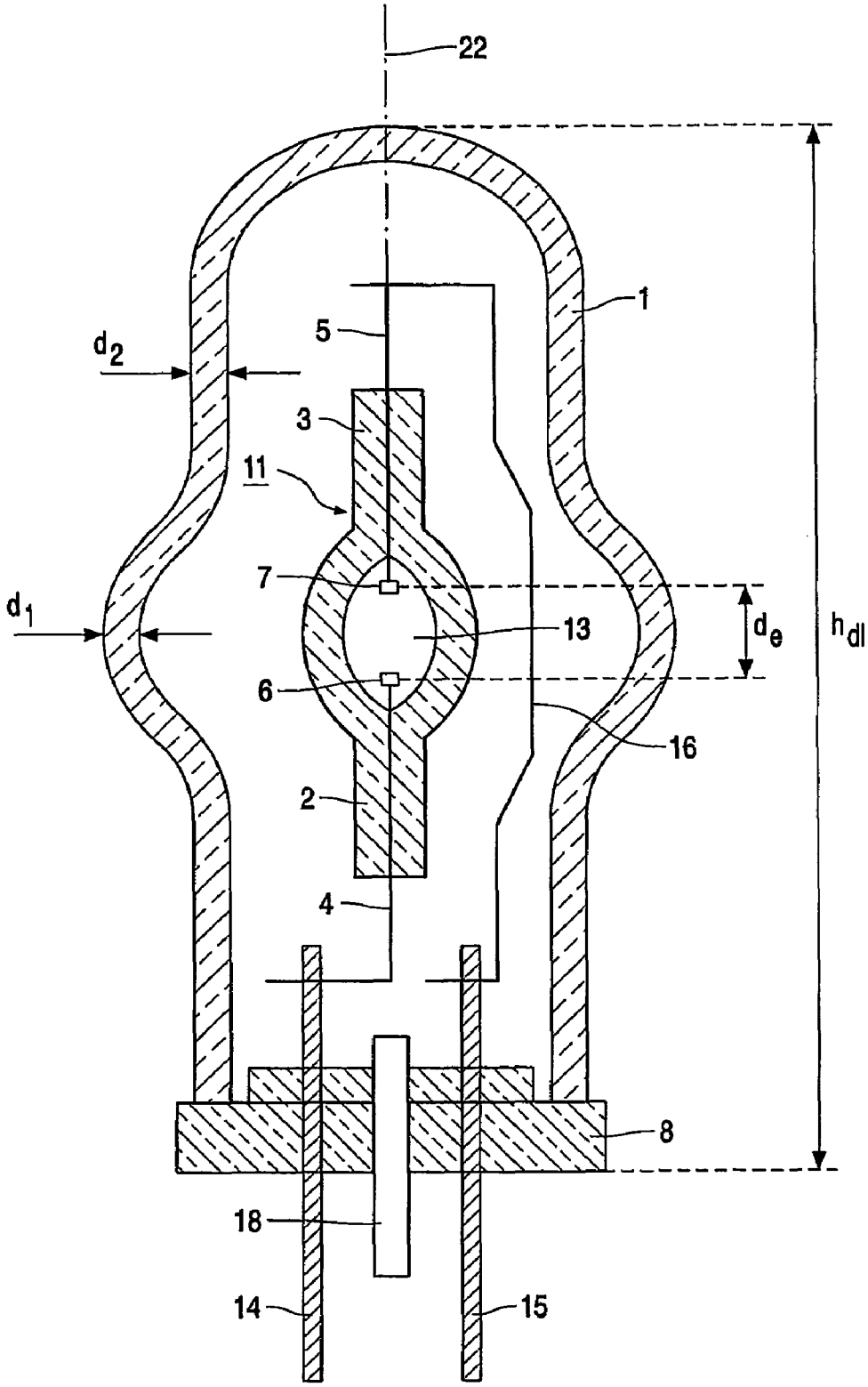

| | | | | |
|---|---|---|---|---|
| 5,594,295 | A * | 1/1997 | Van Gennip et al. | 313/25 |
| 5,719,463 | A * | 2/1998 | Hassink et al. | 313/25 |
| 5,838,104 | A * | 11/1998 | Rutan et al. | 313/560 |
| 2003/0062838 | A1 * | 4/2003 | Niimi | 313/634 |

FOREIGN PATENT DOCUMENTS

| | | |
|---|---|---|
| DE | 3406820 C2 | 10/1984 |
| EP | 0533325 A1 | 6/1993 |

* cited by examiner

HIGH-PRESSURE DISCHARGE LAMP

The invention relates to a high-pressure discharge lamp.

High-pressure discharge lamps ranging from 35 to 150 W have become a dominant player in lighting retail applications. Trends have emerged which create positive conditions for range extensions towards lower lumen packages and/or lower wattages. Lower light levels are being used, for instance in exclusive shops, focusing the light on the goods instead of flooding the area. End users in the market become more and more interested in a uniform quality of the light and would prefer to employ high-pressure discharge lamps instead of halogen lamps for the low lumen packages and accent lighting.

Generally, high-pressure discharge lamps of the kind mentioned in the opening paragraph either have a discharge vessel with a ceramic wall or have a quartz glass discharge vessel. Such high-pressure discharge lamps are widely used in practice and combine a high luminous efficacy with favorable color properties. The discharge vessel of the lamp contains one or several metal halides in addition to Hg and a rare gas filling.

A ceramic wall in the present description and claims is understood to be a wall made from one of the following materials: monocrystalline metal oxide (for example sapphire), densely sintered polycrystalline metal oxide (for example $Al_2O_3$, YAG), and densely sintered polycrystalline metal nitride (for example AlN).

A lamp of the kind mentioned in the opening paragraph is known from U.S. Pat. No. 4,888,517. The known discharge lamp is a double-enveloped lamp having a shield surrounding a light-source capsule within a thick-walled outer envelope, so that the lamp can be safely operated without the necessity of a protective fixture. In the rare event of the light-source capsule bursting, the shield will absorb and dissipate a portion of the burst energy sufficient to permit the thick-walled outer envelope to remain intact and to retain shards and other internal parts within the lamp.

A disadvantage of the known high-pressure discharge lamp is that a shield is necessary in order to operate the discharge lamp safely. This shield makes the lamp relatively large in size.

The invention has for its object to eliminate the above disadvantage wholly or partly. According to the invention, a high-pressure discharge lamp of the kind mentioned in the opening paragraph for this purpose comprises:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current-supply conductor, respectively, extend to a pair of electrodes arranged in the discharge space, the outer envelope having a bulb-shaped portion adjacent the discharge space, the bulb-shaped portion having a wall thickness $d_1$, the remainder of the outer envelope having a wall thickness $d_2$, the ratio of $d_1$ and $d_2$ being in a range of:

$$0.35 \leq \frac{d_1}{d_2} \leq 1.5.$$

If the outer envelope is provided with a bulb-shaped portion having a wall thickness in the range according to the invention, the bulb-shaped portion of the outer envelope has a relative wall thickness which is greater than the relative wall thickness of the bulb-shaped portion in the known discharge lamp. In the known discharge lamp, the envelope is formed by inflation-molding of the hard-glass envelope. The wall thickness is not uniform in the known discharge lamp. In particular, the bulb-shaped portion of the outer envelope of the known discharge lamp has a minimum wall thickness. During the inflation-molding process, the glass is blown into the bulbous shape. As the wall is stretched into the bulb shape, the wall thickness is reduced accordingly in proportion to the degree of stretching. Hence, in the known discharge lamp, the wall has been stretched to the greatest degree in the vicinity of the discharge space. The wall thickness of the outer envelope of the known discharge lamp is a minimum adjacent the discharge space in the discharge vessel. This makes the outer envelope sensitive to bursting, and a protective shield or sleeve is necessary for providing protection in the event explosion phenomena occur in the discharge vessel. The shield or sleeve in the known discharge lamp absorbs and dissipates a portion of the burst energy sufficient to permit the outer envelope to remain intact and to retain shards and other internal parts within the lamp.

Depending on the shape of the bulb-shaped portions, the wall thickness of the known bulb-shaped portion is approximately 30% of the wall thickness of the remainder of the outer envelope. By thickening the wall thickness of the bulb-shaped portion as compared with the wall thickness of the remainder of the outer envelope ($d_1/d_2 \geqq 0.35$), the bulb-shaped portion according to the invention is itself capable of absorbing and dissipating a portion of the burst energy. If the wall thickness of the outer envelope is uniform also in the bulb-shaped portion, the ratio of the wall thickness of the bulb-shaped portion to that of the remainder of the outer envelope is $d_1/d_2 \approx 1$. If $d_1/d_2 \approx 1.5$, the wall thickness of the bulb-shaped portion is greater than the wall thickness of the remainder of the outer envelope, giving additional strength to the bulb-shaped portion.

In the high-pressure discharge lamp according to the invention, the need for a shield or sleeve checking a burst of the discharge vessel is diminished. The omission of the shield or sleeve simplifies the manufacture of the discharge lamp, lowers the cost of the discharge lamp, and improves the visual attractiveness of the discharge lamp. In addition, the discharge lamp according to the invention has relatively small dimensions.

Preferably, the ratio of $d_1$ and $d_2$ is in the range:

$$0.4 \leq \frac{d_1}{d_2} \leq 0.8.$$

In this range, a shield or sleeve in the high-pressure discharge lamp can be safely dispensed with.

A preferred embodiment of the high-pressure discharge lamp according to the invention is characterized in that the bulb-shaped portion of the outer envelope is formed in a mold. This mold renders it possible to realize a wall thickness of the bulb-shaped portion relative to the wall thickness of the remainder of the outer envelope such that said wall thickness is less strongly reduced than it is owing to the stretching into the bulb shape of the bulb-shaped portion as in the known discharge lamp.

Preferably, the outer envelope is made from quartz glass, hard glass or soft glass. Preferably, the discharge vessel has a quartz wall or a ceramic wall.

A preferred embodiment of the high-pressure discharge lamp according to the invention is characterized in that the ratio of the distance $d_e$ between the electrodes to the height $h_{dl}$ of the high-pressure discharge lamp measured along the longitudinal axis lies in a range of:

$$0.02 \leq \frac{d_e}{h_{dl}} \leq 0.2.$$

According to this embodiment of the invention, the height $h_{dl}$ of the high-pressure discharge lamp along the longitudinal axis can be smaller than approximately 50 mm for a distance $d_e$ between the electrodes ranging from approximately 1 mm to approximately 10 mm. The high-pressure discharge lamp according to the invention has the advantage that the discharge vessel has very compact virtual dimensions which render the lamp highly suitable for use in compact lighting applications.

Figure 2:
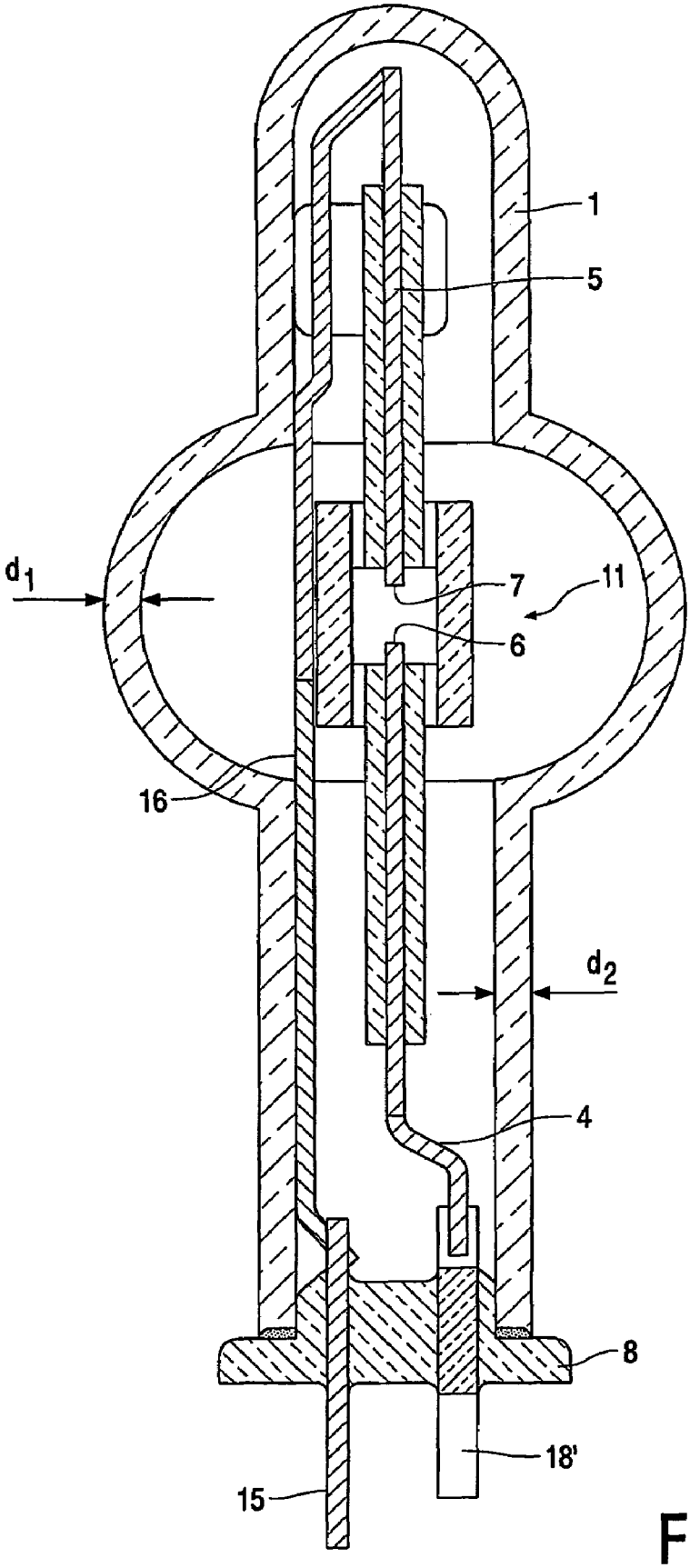
Figure 3:
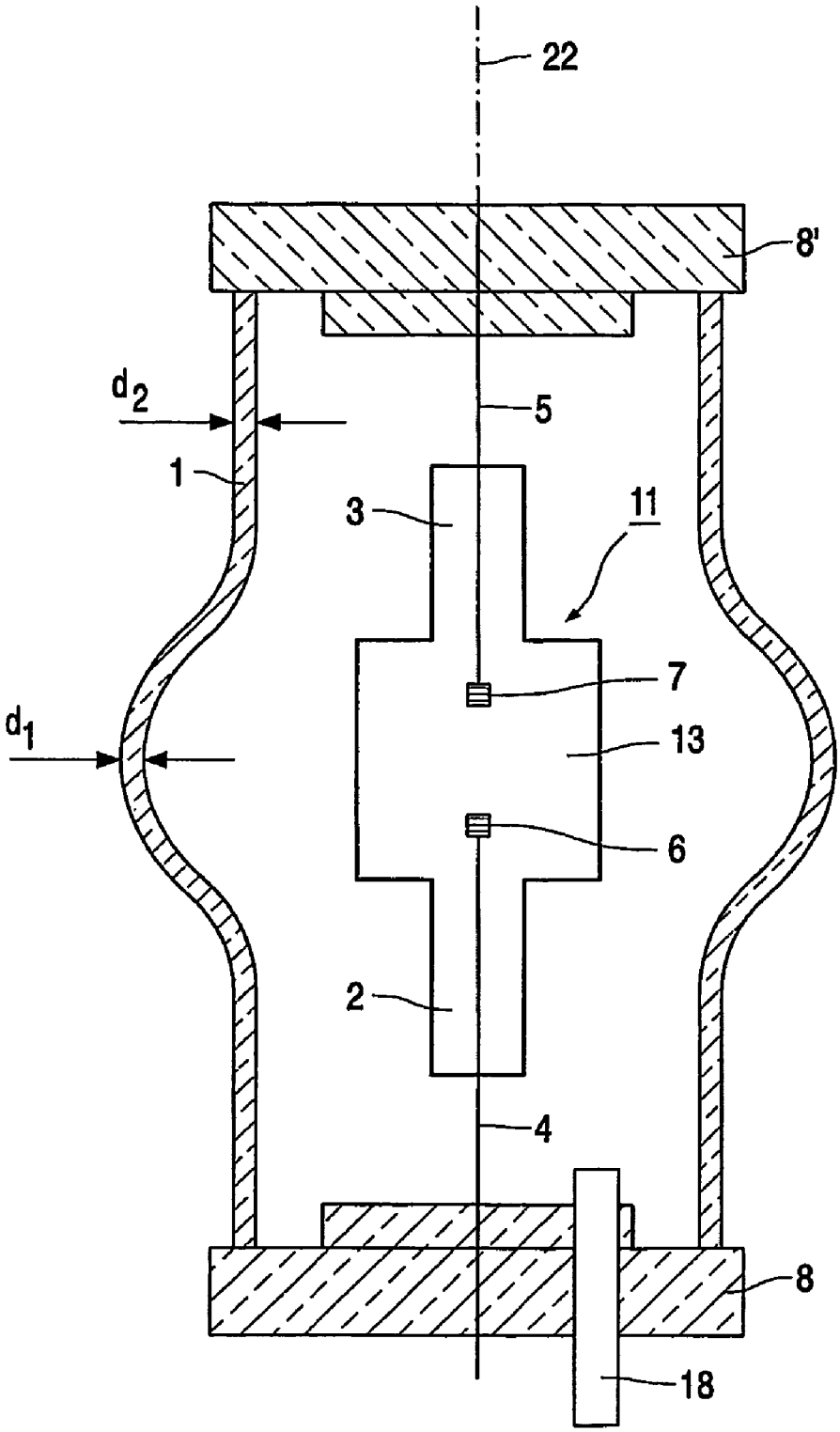

The invention will now be explained in more detail with reference to a number of embodiments and a drawing, in which:

FIG. 1 shows an embodiment of the high-pressure discharge lamp according to the invention, FIG. 2 shows an alternative embodiment of the high-pressure discharge lamp according to the invention, and FIG. 3 shows a further alternative embodiment of the high-pressure discharge lamp according to the invention.

The Figures are purely diagrammatic and not drawn true to scale. Some dimensions are particularly strongly exaggerated for reasons of clarity. Equivalent components have been given the same reference numerals as much as possible in the Figures.

FIG. 1 very diagrammatically shows an embodiment of a high-pressure discharge lamp according to the invention. The high-pressure discharge lamp comprises a discharge vessel 11 arranged around a longitudinal axis 22. The discharge vessel 11 encloses, in a gastight manner, a discharge space 13 provided with an ionizable filling comprising mercury, a metal halide and a rare gas. In the example of FIG. 1, the discharge vessel 11 has a first neck-shaped portion 2 and a second neck-shaped portion 3 opposed thereto, through which portions a first current-supply conductor 4 and a second current-supply conductor 5, respectively, extend to a pair of two electrodes 6, 7, which electrodes 6, 7 are arranged in the discharge space 13. The high-pressure discharge lamp is further provided with a lamp base 8 made from an electrically insulating material. The lamp base 8 supports the discharge vessel 11 by means of the first and second current-supply conductors 4, 5. The lamp base 8 also supports the outer envelope 1. In the example of FIG. 1, the lamp base 8 is provided with a first contact member 14 which is connected to the first current-supply conductor 4. In addition, the lamp base 8 is provided with a second contact member 15 connected to the second supply conductor 5 via a connection conductor 16 running alongside the discharge vessel 11.

In an alternative embodiment, instead of providing contact members, two feed-through tubes may be provided in the lamp base, which allow the current-supply conductors to be fastened in these feed-through tubes. The fastening in these feed-through tubes may be achieved by resistance, laser welding or crimping. An advantage of the use of feed-through tubes instead of the contact members is that more freedom of positioning the discharge vessel on the longitudinal axis of the high-pressure discharge lamp is attained. A further advantage of the use of a feed-through is the elimination of the tubulation 18, simplifying the construction of the discharge lamp and lowering the costs. This may filter improve the precise positioning of the discharge vessel in the outer envelope of the high-pressure discharge lamp.

Preferably, the outer envelope 1 is connected to the lamp base 8 in a gas-tight manner. A control of the atmosphere in the outer envelope 1 protects the current-supply conductors 4, 5 adequately against oxidation. The prevention of oxidation of the current-supply conductors 4, 5 makes it possible to position the current-supply conductors 4, 5 relatively close to the discharge vessel 11. The control of the atmosphere in the outer envelope also makes it possible to avoid press seals and/or tipped-off (quartz) tubulations, resulting in a simplified and compact high-pressure discharge lamp. Preferably, an exhaust tube 18 for evacuating the lamp bulb 1 is provided in the lamp base 8. In this manner, the outer envelope 1 can be evacuated via the exhaust tube 18 after the discharge vessel 11 and the outer envelope 1 have been mounted on the lamp base 8 of the high-pressure discharge lamp. After evacuation and, if so desired, introduction of the desired atmosphere inside the outer envelope, the exhaust tube 18 is sealed off. A getter is preferably used inside the outer envelope, for example a zirconium/aluminum alloy, to absorb impurities, for example water/hydrogen and oxygen. It is advantageous if the exhaust tube 18 in the lamp base 8 is made from a metal or from a pre-oxidized NiCrFe alloy. The exhaust tube 18 is preferably made from a NiFeCr alloy like vacovit.

The lamp base 8 is preferably made from quartz glass, hard glass, soft glass or a ceramic material. In addition, the lamp base 8 is provided as a sintered body, preferably a sintered ceramic body. Preferably, the lamp base 8 is in the form of a plate. The lamp base 8 can be manufactured with a high dimensional accuracy. The lamp base 8 has the additional advantage that it can be made in a light color, for example white or a pale grey. The use of a material with a light color causes light emitted by the discharge vessel 11 to be reflected into usable beam angles, thereby increasing the efficiency of the luminaire or the total efficiency of the high-pressure discharge lamp. It is prevented thereby that the light incident on the lamp base 8 is lost to the light beam, which may be formed by means of a reflector. In addition, it is favorable when the lamp base 8 has a (flat) plane at its surface facing away from the discharge vessel 11. This surface may be mounted against a (lamp) holder, for example a carrier, for example a reflector, and accordingly is a suitable surface for serving as a reference for the position of the discharge vessel 11. In another favorable embodiment, the surface of the lamp base 8 facing the discharge vessel has a central elevation which serves to center the discharge vessel 11 and an enamel ring with respect to the lamp base 8 during the manufacture of the high-pressure discharge lamp.

The outer envelope 1 is preferably made from quartz glass, hard glass or soft glass. The outer envelope 1 is preferably fastened to the lamp base 8 by means of an enamel of (glass) frit. It is favorable when the enamel is provided in the form of a previously shaped ring. The use of such a previously shaped ring largely improves the accuracy of positioning of the discharge vessel 11 during the manufacture of the high-pressure discharge lamp. The choice of the enamel depends on the material of the outer envelope 1 and on the material of the lamp base 8.

According to the invention, part of the outer envelope 1 in FIG. 1 is provided with a bulb-shaped portion 2 adjacent the discharge space 13. In FIG. 1, the bulb-shaped portion 2 has a substantially spherical shape with a wall thickness $d_1$. In FIG. 2, the remainder of the outer envelope (1) has a wall thickness $d_2$. The ratio of the respective wall thicknesses $d_1$, and $d_2$ is in the range:

$$0.35 \leq \frac{d_1}{d_2} \leq 1.5.$$

The outer envelope with a bulb-shaped portion having a wall thickness in the range according to the invention implies that the bulb-shaped portion of the outer envelope has a relative wall thickness which is greater than the relative wall thickness of the bulb-shaped portion in the known discharge lamp. The wall thickness is not uniform in the known discharge lamp. In particular, the bulb-shaped portion of the outer envelope of the known discharge lamp has a minimum wall thickness. This makes the outer envelope sensitive to bursting, and a protective shield or sleeve is necessary to provide protection in the event explosion phenomena occur in the discharge vessel. In the known discharge lamp, the shield or sleeve absorbs and dissipates a portion of the burst energy sufficient to permit the outer envelope to remain intact and to retain shards and other internal parts within the lamp.

Depending on the shape of the bulb-shaped portion, the wall thickness of the bulb-shaped portion of known discharge lamps is approximately 30% of the wall thickness of the remainder of the outer envelope. In other words, $d_1/d_2 \approx 0.3$. Thickening of the wall thickness of the bulb-shaped portion with respect to the wall thickness of the remainder of the outer envelope ($d_1/d_2 \geqq 0.35$) according to the invention makes the bulb-shaped portion itself capable of absorbing and dissipating a portion of the burst energy. If the wall thickness of the outer envelope is uniform also in the bulb-shaped portion, the ratio of the wall thickness of the bulb-shaped portion to that of the remainder of the outer envelope is $d_1/d_2 \approx 1$. If $d_1/d_2 \approx 1.5$, the wall thickness of the bulb-shaped portion is greater than the wall thickness of the remainder of the outer envelope, giving additional strength to the bulb-shaped portion.

In the high-pressure discharge lamp according to the invention, the need for a shield or sleeve containing a burst of the discharge vessel is eliminated. Not incorporating the shield or sleeve simplifies the manufacture of the discharge lamp, lowers the cost of the discharge lamp, and improves the visual attractiveness of the discharge lamp. In addition, the discharge lamp according to the invention has relatively small dimensions.

Preferably, the ratio of $d_1$ and $d_2$ is in the range:

$$0.4 \leq \frac{d_1}{d_2} \leq 0.8.$$

In this range, a shield or sleeve in the high-pressure discharge lamp can be safely dispended with. In a favorable embodiment of the high-pressure discharge lamp according to the invention, the ratio $d_1/d_2 \approx 0.5$.

FIG. 2 schematically shows an alternative embodiment of the high-pressure discharge lamp according to the invention. In this embodiment, the exhaust tube 18' also forms a feed-through tube to which the current-supply conductor 4 is fastened.

FIG. 3 schematically shows a further alternative embodiment of the high-pressure discharge lamp according to the invention. FIG. 3 shows a so-called double-ended embodiment of the high-pressure discharge lamp. Two lamp bases 8, 8' are provided with a substantially cylindrical outer envelope 1 between them. The exhaust tube 18 is preferably provided only in one of the lamp bases 8.

A simplified and compact high-pressure discharge lamp can be made in that the atmosphere in the outer envelope is controlled. In particular, the length of the high-pressure discharge lamp can be significantly reduced. To this end, a preferred embodiment of the high-pressure discharge lamp is characterized in that the ratio of the distance $d_e$ between the electrodes to the height $h_{dl}$ of the high-pressure discharge lamp measured along the longitudinal axis lies in a range of:

$$0.02 \leq \frac{d_e}{h_{dl}} \leq 0.2.$$

According to the invention, a simplified lamp design is provided which can be used as a building block for a family of products based on a modular capsule lamp. The discharge vessel 11 is supported on the current-supply conductors 4, 5 that are fixedly connected to the base plate 8. The discharge vessel 11 as well as the current-supply conductors 4, 5 are positioned in the outer envelope 1 which is kept under a controlled atmosphere. Elimination of the press seals and and/or tipped-off (quartz) tubulations results in a compact high-pressure discharge lamp. Preferably, the height $h_{dl}$ of the high-pressure discharge lamp is equal to or less than 50 mm, preferably less than 40 mm. In addition, positioning issues of the discharge vessel 11 are eliminated due to the more controlled manufacture of the high-pressure discharge lamp with respect to the longitudinal axis 22 and, in addition, the discharge vessel 11 can be accurately positioned in a plane orthogonal to the longitudinal axis 22.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current-supply conductor, respectively, extend to a pair of electrodes arranged in the discharge space, the outer envelope having a bulb-shaped portion adjacent the discharge space, the bulb-shaped portion having a wall thickness $d_1$, the remainder of the outer envelope having a wall thickness $d_2$, and a ratio of $d_1$ and $d_2$ is in a range of:

$$0.35 \leq \frac{d_1}{d_2} \leq 0.6 \text{ or } 1.0 \leq \frac{d_1}{d_2} \leq 1.5$$

wherein the high-pressure discharge lamp does not comprise a shield for containing a burst of the discharge vessel.

2. A high-pressure discharge lamp as claimed in claim 1, wherein the outer envelope comprises a quartz glass, hard glass or soft glass.

3. A high-pressure discharge lamp as claimed in claim 2, wherein the bulb-shaped portion of the outer envelope is formed in a mold.

4. A high-pressure discharge lamp as claimed in claim 1, wherein the discharge vessel comprises a quartz wall or a ceramic wall.

5. A high-pressure discharge lamp as claimed in claim 1, wherein the ratio of the distance $d_e$ between the electrodes to the height $h_{dl}$ of the high-pressure discharge lamp measured along the longitudinal axis lies in a range of:

$$0.02 \leq \frac{d_e}{h_{dl}} \leq 0.2.$$

* * * * *